US005317329A

United States Patent [19]

Hatasa

[11] Patent Number: 5,317,329

[45] Date of Patent: May 31, 1994

[54] MICROWAVE DETECTOR AND HORN ANTENNA STRUCTURE THEREFOR

[75] Inventor: Takeshi Hatasa, Toyota, Japan

[73] Assignee: Yupiteru Industries Co., Ltd., Japan

[21] Appl. No.: 914,641

[22] Filed: Jul. 16, 1992

Related U.S. Application Data

[63] Continuation of Ser. No. 587,797, Sep. 25, 1990, abandoned.

[30] Foreign Application Priority Data

Sep. 26, 1989 [JP] Japan ..... 1-250043

[51] Int. Cl.[5] ..... H01Q 13/02

[52] U.S. Cl. ..... 343/786; 343/772; 455/271

[58] Field of Search ..... 343/783, 786, 700 MS, 343/772, 702; 455/271, 281, 327, 328; H01Q 13/00, 13/06, 1/22, 1/44

[56] References Cited

U.S. PATENT DOCUMENTS

| | | | |
|---|---|---|---|
| 2,822,541 | 2/1958 | Sichak et al. | 343/776 |
| 3,778,717 | 12/1973 | Okoshi et al. | 343/772 |
| 4,353,072 | 10/1982 | Monser | 343/786 |
| 4,571,593 | 2/1986 | Martinson | 343/786 |
| 4,613,989 | 9/1986 | Fende et al. | 343/786 |
| 4,644,362 | 2/1987 | Rammos | 343/786 |
| 4,819,004 | 4/1989 | Argintaru et al. | 343/786 |
| 5,126,751 | 6/1992 | Wada et al. | 343/786 |

FOREIGN PATENT DOCUMENTS 0500944 5/1986 Japan ..... H01Q 13/02

OTHER PUBLICATIONS

Begemann et al., Ku-Band Front-End in Integrated Fin-Line Technique, Arch. Elektron & Uebertragungstech, Apr. 1980, pp. 179-180.

*Primary Examiner*—William Mintel
*Assistant Examiner*—Peter Toby Brown
*Attorney, Agent, or Firm*—Venable, Baetjer, Howard & Civiletti

[57] ABSTRACT

A microwave detector arranged in such a manner that a horn antenna element is fastened to the surface of a microstrip plate having a ground plate on its reverse side. The horn antenna element and the ground plate constitute a microwave receiving antenna so that the height of the microstrip plate is lowered. As a result, a compact microwave detector can be constituted.

1 Claim, 2 Drawing Sheets

MICROWAVE DETECTOR AND HORN ANTENNA STRUCTURE THEREFOR

This application is a continuation of application Ser. No. 587,797, filed Sep. 25, 1990, now abandoned.

BACKGROUND OF THE INVENTION

1. Field of the Invention

The present invention relates to a microwave detector, and, more particularly, to a horn antenna structure therefor.

2. Brief Description of Related Art

A variety of microwave detectors, each of which is provided with a horn antenna for receiving microwave energy, have been disclosed.

For example, a structure disclosed in Japanese Patent Application Publication No. 61-500944 has been known. That is, a horn antenna element manufactured by one-piece molding is provided in such a manner that it can be mounted on a microstrip plate (called a "fastening plate" in the above-described disclosure). The above-described horn antenna element is arranged in such a manner that the antenna portion thereof, a local oscillator disposed on the microstrip plate and a shield portion for covering the mixer are integrally formed. The above-described shield portion constitutes a resonant circuit in the form of a 3-D structure and acts to prevent the external energy radiation at the local oscillating frequency.

The above-described horn antenna element has the inlet portion (which receives the microwave energy) and the bottom portion each of which is opened, the horn antenna element being made of an electroconductive material having only the top portion and the side portion.

The above-described antenna element has a shape the cross sectional area of which is gradually reduced from the inlet portion thereof.

The microstrip plate, on which the above-described horn antenna element is mounted, has a ground plate in at least a region in which said antenna and said shield portion are covered, the ground plate being formed by the same manufacturing process as that for manufacturing the microstrip or the circuit layer.

The "microstrip" is an element of a microstrip line containing component capacitor or inductor and integrally formed with the ground plate formed on the reverse side via a dielectric substrate.

The above-described horn antenna element is fixed to the microstrip plate by a screw which is inserted into the microstrip plate. At this time, the horn antennal element and the ground plate are electrically connected to each other by the above-described screw so that the ground plate serves as the bottom wall of the horn antenna element.

The local oscillator and the mixer are disposed in the shield portion of the above-described horn antenna element, the local oscillator and the mixer being included in the structure formed on the dielectric substrate made of, for example, ceramics so as to be integrally disposed.

However, according to the above-described conventional technology, the ground plate on the portion of the microstrip plate in which the horn antenna is mounted is used so as to serve as the bottom wall of the horn antenna element in order to lower the height of the horn element and to reduce the overall size of the microwave detector.

However, the realized size reduction has not been satisfactory to meet the desire to further reduce the size of the microwave detector. Therefore, there has been a desire to further lower the height of the above-described horn element.

Furthermore, another problem arises in that the number of the manufacturing process increases since the above-described local oscillator and the mixer are included on the structure of the dielectric substrate made of, for example, ceramics so as to be disposed in said horn antenna element (correctly, in the shield portion).

The reason why the above-described local oscillator and the mixer must be mounted on the microstrip plate on top of the dielectric substrate is that the ground plate is formed on the microstrip plate on the same side on which the horn antenna element is mounted and is used as the bottom wall of the above-described horn antenna element.

Furthermore, the above-described structure in which the local oscillator and the mixer are included via the dielectric substrate causes a necessity of establishing an electric connection with other circuits in the portions except for the region on which the horn antenna element is mounted. As a result, another problem arises in that the impedance matching with the above-described other circuits cannot be easily realized.

SUMMARY OF THE INVENTION

Accordingly, an object of the present invention is to provide a microwave detector structured so as to further lower the height of the horn antenna element and a high frequency circuit can thereby be directly included in the horn antenna element without the necessity of using the dielectric substrate such as the ceramic substrate so that the number of the necessary manufacturing processes is reduced. Furthermore, the impedance matching between the above-described high frequency circuit and other circuits in the portions except for the region on which the horn antenna element is mounted can be easily realized.

In order to achieve the above-described object, an aspect of the present invention lies in a microwave detector comprising: a microstrip plate having a dielectric substrate on which at least a ground plate is formed on the side opposite to the main surface thereof; a horn antenna element mounted on the main surface of the microstrip plate; and a high frequency circuit disposed on the main surface of the microstrip plate in the horn antenna element, wherein the horn antenna element is made of an electroconductive material arranged in such a manner that the inlet portion of a horn thereof and the bottom portion are opened and the top surface and the side surface are provided, the ground plate is disposed in a region on which the horn antenna element is mounted on the side opposite to the main surface of the microstrip plate and the high frequency circuit is combined with a microstrip formed on the main surface of the microstrip plate in the horn antenna element.

The thus constituted microwave detector is arranged in such a manner that the ground plate formed on the side of the microstrip plate opposite to the side on which the horn antenna element is mounted also serves as the bottom wall of the above-described horn antenna element.

Therefore, the height from the ground plate to the top surface of the horn antenna element can be set as the height of the horn antenna. As a result, the height can be lowered by the degree which substantially corresponds to the thickness of the microstrip plate in comparison to the conventional structure.

Furthermore, the microstrip formed on the side of the microstrip plate on which the horn antenna element is mounted is arranged not to constitute the horn antenna element. Therefore, it can be used as an element for the high frequency circuit mounted on the main surface of the microstrip plate. As a result, the high frequency circuit can be directly integrated with the microstrip formed on the main surface of the microstrip plate in the horn antenna element without the necessity of using, for example, the ceramic plate.

As a result, the necessary number of the processes for manufacturing the microwave detector can be reduced. Furthermore, the necessity of using a special method of establishing a connection with the other circuits on the microstrip plate in the portions except for the region in which the horn antenna element is formed can be eliminated. Therefore, the impedance matching over the circuits can be easily realized.

Other and further objects, features and advantages of the invention will be appear more fully from the following description.

DESCRIPTION OF PREFERRED EMBODIMENTS

An embodiment of a microwave detector according to the present invention will now be described.

Figure 1:
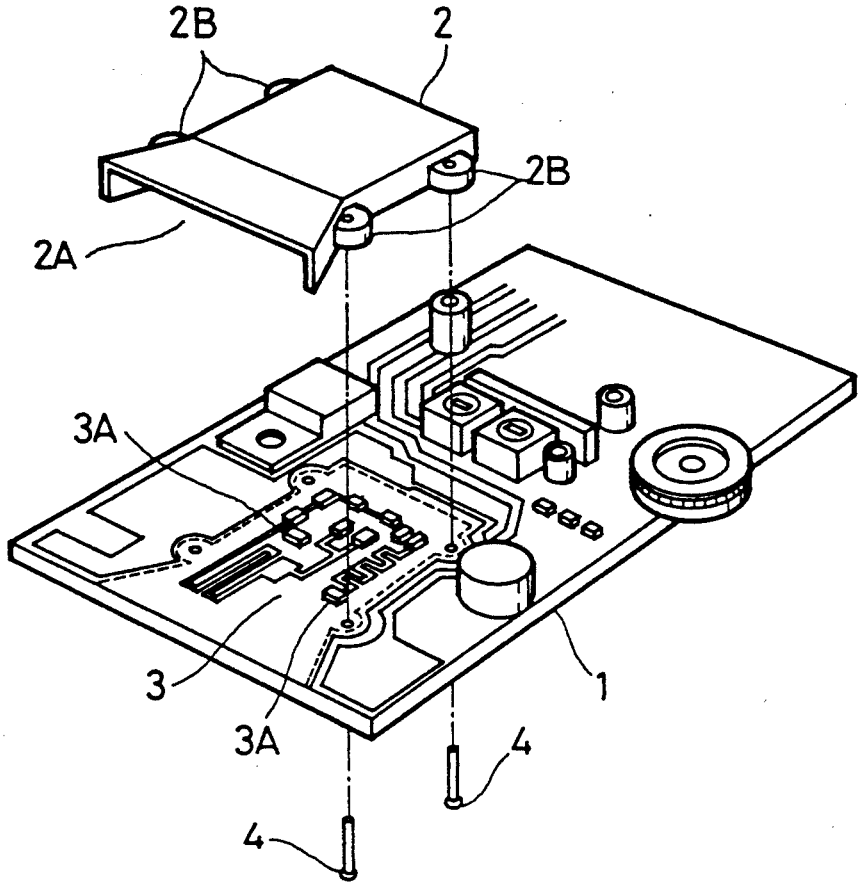
FIG. 1 is a perspective view which illustrates the shape of the microwave detector which is included in a microstrip plate and the horn antenna element of which has been removed.

FIG. 1 is a structural view which illustrates the shape of a detector circuit included in a microwave strip plate. FIG. 1 illustrates a microstrip plate 1 to be described later and comprising a dielectric substrate having a main side and another side on each of which a microstrip and a ground plate 1B, 1D made of, for example, copper foil are formed. Furthermore, an insulating film is formed on the main side and the other side of the dielectric substrate so as to cover the microstrip and the ground plate.

A horn antenna element 2 is arranged to be mounted on the main side of the microstrip plate 1, the horn antenna element 2 having an inlet portion 2A, that is, the portion which receives microwave energy and which is positioned at an edge of the above-described microstrip plate 1.

The horn antenna element 2 has a cross sectional shape the area of which becomes the largest at the inlet portion 2A, the cross sectional area being in inverse proportion to the distance from the inlet portion 2A. The cross sectional area becomes constant from a predetermined distance. The above-described inlet portion 2A and the bottom portion are opened. Therefore, the horn antenna element 2 has only the top side and the side surface.

The portion of the horn antenna element 2, the cross sectional area of which is reduced, forms an antenna portion, while the portion, the cross sectional area of which is arranged to be constant, forms a shield portion.

For example, four screw fastening portions 2B are formed on the side surface of the horn antenna element 2 so as to be fixed to the above-described microstrip plate by using screws.

Figure 2:
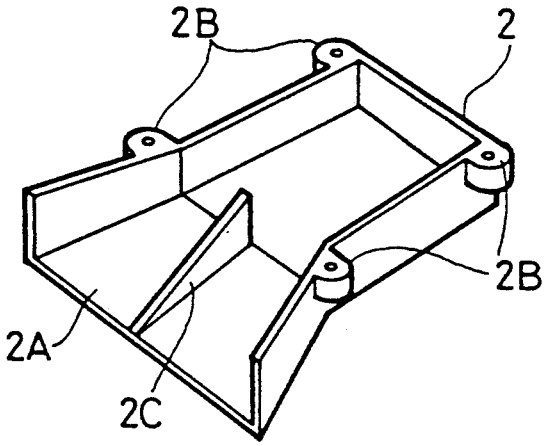
FIG. 2 is a perspective view which illustrates the horn antenna element shown in FIG. 1 when viewed from the reverse side.

As shown in FIG. 2 which illustrates the reverse side of the horn antenna element 2, the top surface of the horn element 2 has a ridge 2C formed from the inlet portion 2A in such a manner that its height is gradually enlarged in proportion to the distance from the inlet portion 2. The ridge 2C will be further described later.

The above-described horn antenna element 2 is a one-piece molded part formed by integrally molding the screw fastening portions 2B and the ridge 2C, the horn antenna element 2 being made of an electroconductive material. In this case, the horn antenna element made of the electroconductive material is not limited to the structure the material of which is an electroconductive material. For example, it may be formed by applying an electroconductive thin film to the surface of the insulating material.

A local oscillator and a mixer 3 are formed in a region (designated by a dotted line) of the microstrip plate 1 on which the horn antenna element 2 is to be mounted. The local oscillator and the mixer 3 are disposed within the above-described horn antenna element 2 in order to prevent the external energy radiation at the frequency thereof. The local oscillator and the mixer 3 are directly mounted on the microstrip plate 1 without, for example, a ceramic plate.

That is, the local oscillator and the mixer 3 are formed on the main surface of the microstrip plate 1 together with the microstrip formed on the main surface of the same and the ground plate formed on the reverse side of the same.

Figure 3:
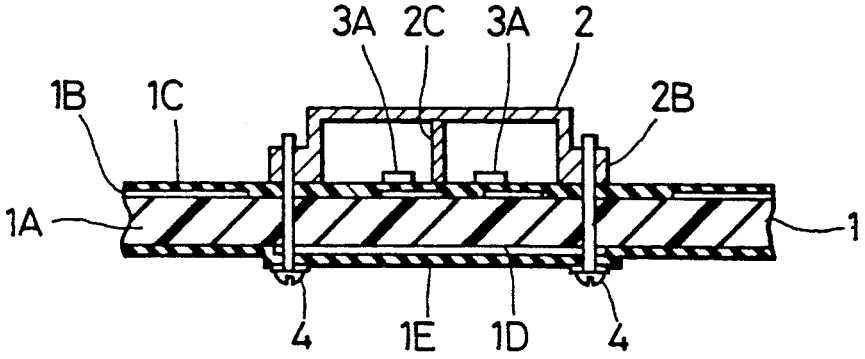
FIG. 3 is a cross sectional view which illustrates the case in which the horn antenna element is included in the microstrip plate.

FIG. 3 is a cross sectional view which illustrates a state where the horn antenna element 2 is fastened to the microstrip plate 1 on which the local oscillator and the mixer 3 are formed as described above. Referring to the drawing, the horn antenna element 2 is fastened at its screw fastening portions 2B by screws 4 inserted from the opposite side of the main surface of the microstrip plate 1. The above-described local oscillator and the mixer 3 are mounted on the main surface of the microstrip plate 1 in the horn antenna element 2. The microstrip plate 1 is constituted in such a manner that a microstrip and ground plate layer 1B made of, for example, copper foil, is formed on the main surface of a dielectric substrate 1A and an insulating film 1C is formed on the main surface of the dielectric substrate 1A so as to cover the thus formed microstrip and ground plate layer 1B.

The microstrip of the microstrip and ground plate layer 1B is positioned in the region of the horn antenna element 2, that is, in the region in which the local oscillator and the mixer 3 are formed. The microstrip serves as a component of the local oscillator and the mixer 3.

In the case where the horn antenna element 2 is fastened to the microstrip plate 1 by the screw, the ridge 2C provided for the horn antenna element 2 is arranged to physically and electrically come in contact with the microstrip of the local oscillator and the mixer 3.

In this case, if the high frequency connection is established, the physical contact can, of course, be eliminated.

Furthermore, other circuits necessary to be provided for the microwave detector are formed on the main surface of the microstrip plate 1 in the portions except for the region on which the horn antenna element 2 is mounted. The above-described electronic parts are connected to each other by mainly using the microstrip and ground plate layer 1B.

On the other hand, a microstrip and ground plate layer 1D is, as shown in FIG. 3, formed on the surface of the dielectric substrate 1A on the opposite side of the main surface of the microstrip plate 1. Furthermore, an insulating film 1E is formed so as to cover the above-described microstrip and ground plate layer 1D. Only the ground plate layer is positioned in the region of the microstrip and ground plate layer 1D corresponding to the region in which the horn antenna element 2 is formed.

The screws 4 are inserted into the ground plate layer so that the ground plate layer and the horn antenna element are electrically connected to each other. That is, as a result of the structure thus arranged, the ground plate layer forms the bottom portion of the horn antenna element 2.

Figure 4:
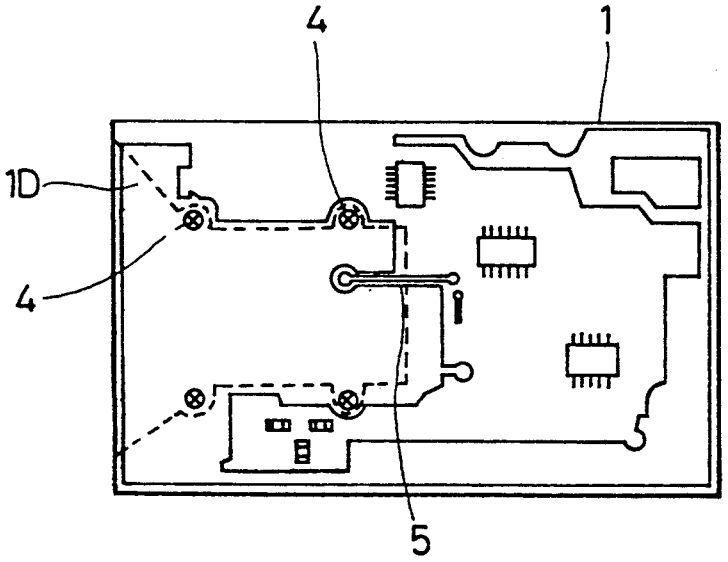
FIG. 4 is a plan view which illustrates the side opposite to the main surface of the microstrip plate.

FIG. 4 illustrates the opposite side of the main surface of the microstrip plate 1. The ground plate layer of the microstrip and ground plate layer 1D is positioned in at least the region (designated by a dotted line) in which the horn antenna element 2 is fastened. The microstrip 5 drawn out from the region, in which the horn antenna element 2 is fastened, by separating from the above-described ground plate layer forms, by a known through hole technology, a circuit for transmitting a signal from an electric circuit mounted on the opposite side of the microstrip plate 1 to the local oscillator and the mixer 3 mounted on the main surface of the microstrip plate 1.

Referring to FIG. 4, other circuits (ICs or the like) necessary to be provided for the microwave detector are formed on the main surface of the microstrip plate 1 in the portions except for the region on which the horn antenna element 2 is mounted. The electronic parts of the above-described circuits are connected to one another by mainly using circuits formed by the same manufacturing process as those for manufacturing the microstrip and ground plate layer 1D.

According to the above-described embodiment, the horn antenna element 2 and the ground plate 1D are connected to each other by using the screws 4. However, the present invention is not limited to the above-described screws 4. For example, a circuit formed for covering the two sides of the microstrip plate 1 may be employed in order to establish the above-described connection.

According to the above-described embodiment, the horn antenna element 2 includes the local oscillator and the mixer 3. However, the present invention is not limited to the above-described structure. For example, a structure may be employed in which the local oscillator and the mixer 3 are formed outside the region in which the horn antenna element 2 is formed. Furthermore, a microstrip line amplifier is formed in the horn antenna element 2.

In this case, when a so-called direct wave detector method is employed in the microwave detector, the local oscillator or the mixer 3 can be eliminated if the microstrip line amplifier is provided in the horn antenna element 2.

Therefore, a high frequency circuit may be included in the horn antenna element 2.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A microwave detector, comprising:

a microstrip plate comprising a dielectric substrate having a first side and an opposite second side, a high frequency circuit disposed on said dielectric substrate on said first side, and a ground plate mounted to said dielectric substrate on said second side; and a horn antenna element comprising an electroconductive material, said horn antenna element having a top wall, a side wall extending from said top wall, and an open bottom, and being mounted to said first side of said dielectric substrate and over said high frequency circuit;

wherein said ground plate and said horn antenna element are mounted opposite each other such that a horn antenna is formed therebetween, said horn element having a cross-sectional shape, the area of which is gradually reduced from an inlet portion toward the inside of said horn antenna element and which is constant thereafter, said horn element being fastened to said microstrip plate by a screw which establishes an electrical connection between said horn antenna element and said ground plate, the top wall of said horn antenna element being provided with a ridge on an interior surface thereof, said ridge gradually increasing in height from said inlet portion toward the inside of said element.

* * * * *